US006089964A

United States Patent [19]

Adams

[11] Patent Number: 6,089,964

[45] Date of Patent: Jul. 18, 2000

[54] GRINDING WHEEL SHIELD FOR EDGE GRINDING MACHINE

[75] Inventor: Craig W. Adams, Vancouver, Wash.

[73] Assignee: SEH America, Inc., Vancouver, Wash.

[21] Appl. No.: 08/984,160

[22] Filed: Dec. 3, 1997

[51] Int. Cl.[7] ..... B24B 55/04

[52] U.S. Cl. ..... 451/451; 451/453; 451/455

[58] Field of Search ..... 451/451, 452, 451/453, 455, 456, 457, 428, 442, 415, 41, 42, 344, 359, 349, 353, 441, 490, 496, 435; 83/440.2, 544, 814

[56] References Cited

U.S. PATENT DOCUMENTS 4,864,779 9/1989 Ozaki .
5,185,965 2/1993 Ozaki .

*Primary Examiner*—Derris Holt Banks

*Attorney, Agent, or Firm*—Evenson, McKeown, Edwards & Lenahan, P.L.L.C.

[57] ABSTRACT

A grinding wheel shield for a semiconductor wafer edge grinding machine formed with a flat upper surface having a central aperture therein for accommodating the grinding wheel shaft and motor of the grinding machine on which the shield is installed, an open keyway slot leading from the central aperture to an adjacent edge of the shield, a depending flange extending from at least a portion of the periphery of the upper surface, and at least one positioning member projecting from the depending flange, the shield being a unitary member machined from a single block of resilient polymeric material, and a sheet of resilient material disposed on top of the flat upper surface with an opening aligned with the central aperture of the shield and a slit extending from the opening over the keyway slot to the edge of the shield such that the sheet forms at least one flexible flap over the keyway slot.

15 Claims, 2 Drawing Sheets

GRINDING WHEEL SHIELD FOR EDGE GRINDING MACHINE

BACKGROUND OF THE INVENTION

The presently claimed invention relates to an improved grinding wheel shield for a semiconductor wafer edge grinding machine.

Semiconductor wafers, such as un-doped or doped silicon wafers, are used in the production of electronic devices ranging from individual diodes or transistors to very large scale integrated circuits (VLSIs). Such wafers are obtained by sliding disk-like slices from long ingots or rods of single crystal semiconductor material using a diamond saw and then polishing the slides (referred to hereinafter a wafers) over and over again using a mechano-chemical process to obtain a mirror-like finish. A critical intermediate step in the wafer production process is edge grinding, which typically occurs between the slicing and polishing steps. Edge grinding serves to give the wafers a desired circumferential shape and edge configuration, as well as to form orientation flats or notches, if desired. Examples of edge grinding are disclosed in Okazaki, U.S. Pat. Nos. 4,864,779 and 5,185,965, the disclosures of which are hereby incorporated by reference.

Edge grinding is carried out in automated machines in which the semiconductor wafer is held in a chuck and contacted by a rotating grinding wheel, with the wafer and the grinding wheel being moved along a carefully defined path relative to each other. The required relative movement may be achieved by displacement of either the wafer or the grinding wheel, but preferably both are moved in accordance with a precise machine control scheme designed to reflect the desired final water configuration and programmed into the grinding machine. A useful machine for wafer edge grinding is commercially available from Emtec Co. Ltd. of Tokyo, Japan as the Emtec Model DNEP 250 Edge Grinder.

Of course, the grinding process produces significant amounts of dust which necessarily must be controlled. Consequently, it is customary to provide the edge grinding machines with a shield over the grinding wheel, i.e. above the grinding wheel notch, which shield helps to contain the grinding dust and water or glycol based coolant and facilitate collection thereof. A conventional grinding wheel shield is shown in FIGS. 1*a–c*. As can be seen from the drawings this shield 10, which is made of transparent acrylic plastic, comprises a flat top plate 11, a downwardly extending side plate 12, two downwardly extending end plates 13, two projecting positioning plates 14, and two elongated reinforcing blocks 15, all solvent welded to each other. Thus the shield is formed from a eight precisely cut and drilled pieces of stock material assembled together in a precise manner. The need for precision in both the cutting and drilling of the individual pieces and in the subsequent assembly operation in order to obtain a functional fit with the edge grinding machine makes such shields rather expensive to manufacture despite their simple appearance.

Another problem with the conventional shields is the blow-by of grinding dust and/or coolant through the central aperture provided for the grinding wheel shaft and motor. Even with the use of an auxiliary skirt seal or a metal retainer and seal, some blow-by of grinding dust and coolant occurs, thereby contaminating the work environment.

Moreover, despite the use of systems to collect the dust as it is formed, sludge build-ups occur in the grinding machine, and the shields must be periodically removed, e.g. weekly, to facilitate cleaning residual sludge from the machine, as well as for routine inspection and corrective adjustments. Unfortunately, the conventional shield cannot be removed without dismantling the platform above the grinding wheel. Platform dismantling requires a Z-axis table adjustment, which in turn requires re correlation or recalibration of the grinding machine before wafer edge grinding can be resumed. This increases the difficulty and the time required for cleaning, which correspondingly increases the time the machine cannot be used and reduces productivity.

In addition, the conventional acrylic shield is prone to breakage, particularly during removal for cleaning. Even the provision of reinforcing blocks over the mounting screw apertures on the top of the shield does not eliminate the potential for breakage. As a result the shields must be replaced after only a few months of use, on average. Due to the not insubstantial cost of the shield, this relatively short average working life results in a significant economic burden for wafer manufacturers.

SUMMARY OF THE INVENTION

It is therefore an object of the invention to provide an improved grinding wheel shield for a wafer edge grinding machine.

Another object of the invention is to provide a grinding wheel shield which is relatively inexpensive to produce compared to conventional shields.

A further object of the invention is to provide a grinding wheel shield which can be removed for cleaning, inspection and/or machine adjustments without dismantling the platform above the grinding wheel or having to make a Z-axis table adjustment necessitating subsequent machine recalibration of the grinding machine.

An additional object of the invention is to provide a grinding wheel shield which is highly durable and breakage resistant.

Yet another object of the invention is to provide a grinding wheel shield which reduces blow-by of grinding dust and/or coolant without auxiliary seals.

These and other objects have been achieved in accordance with the present invention by providing a grinding wheel shield for an edge grinding machine, the shield being formed with a flat upper surface having a central aperture therein for accommodating a grinding wheel shaft and motor of a grinding machine on which the shield is installed, an open keyway slot leading from the central aperture to an adjacent edge of the shield, a depending flange extending from a portion of the periphery of the upper surface, and at least one positioning member projecting from the depending flange, the shield comprising a unitary member machined from a single block of resilient polymeric material.

BRIEF DESCRIPTION OF THE DRAWINGS

The invention will be described in further detail hereinafter with reference to the accompanying drawings in which.

DETAILED DESCRIPTION OF PREFERRED EMBODIMENTS

Figure 1C:
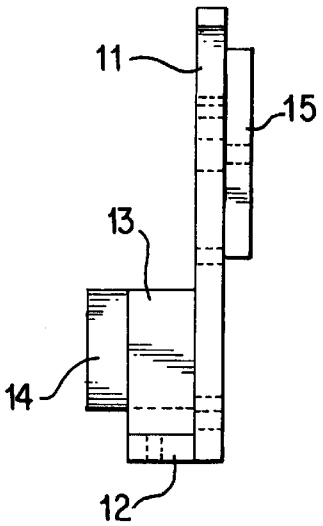
FIG. 1c PRIOR ART
FIGS 1*a–c* show a bottom plan view, a side elevation view and an end view, respectively, of a conventional grinding wheel shield as described above.
Figure 1B:
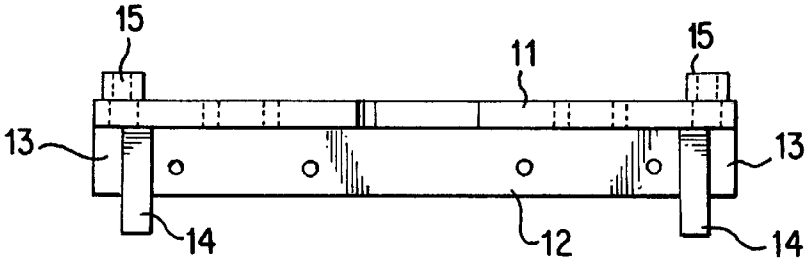
FIG. 1b PRIOR ART
Figure 1A:
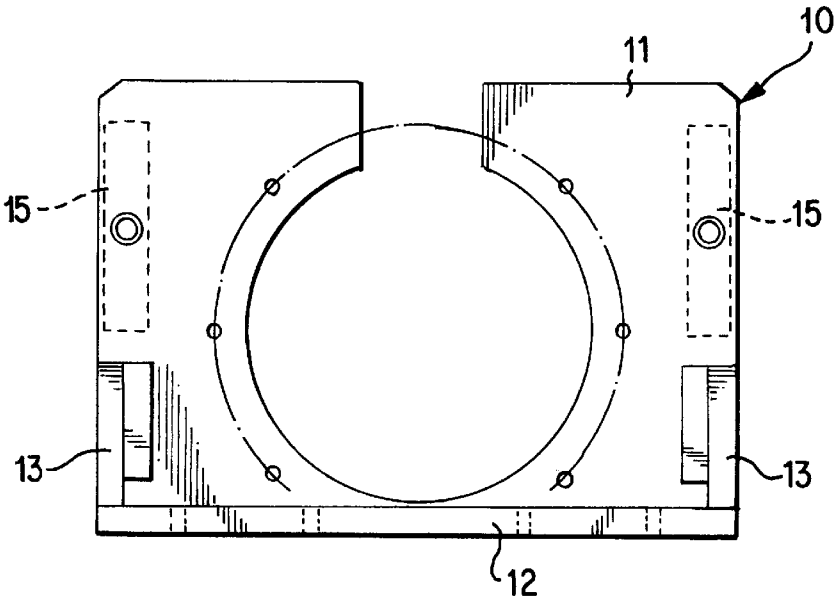
FIG. 1a PRIOR ART
Figure 2C:
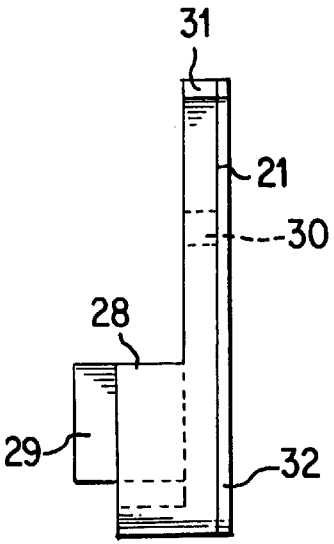
FIGS. 2*a–c* show bottom plan view, a side elevation view and an end view, respectively, of a grinding wheel shield according to the present invention.
Figure 2B:
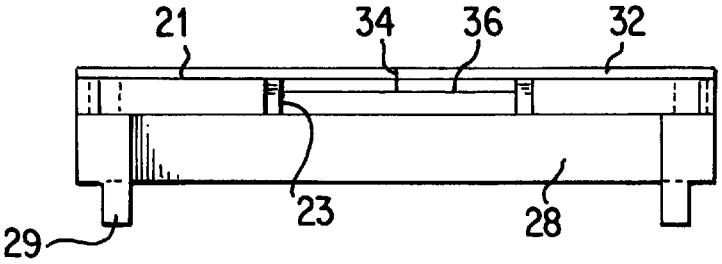
Figure 2A:
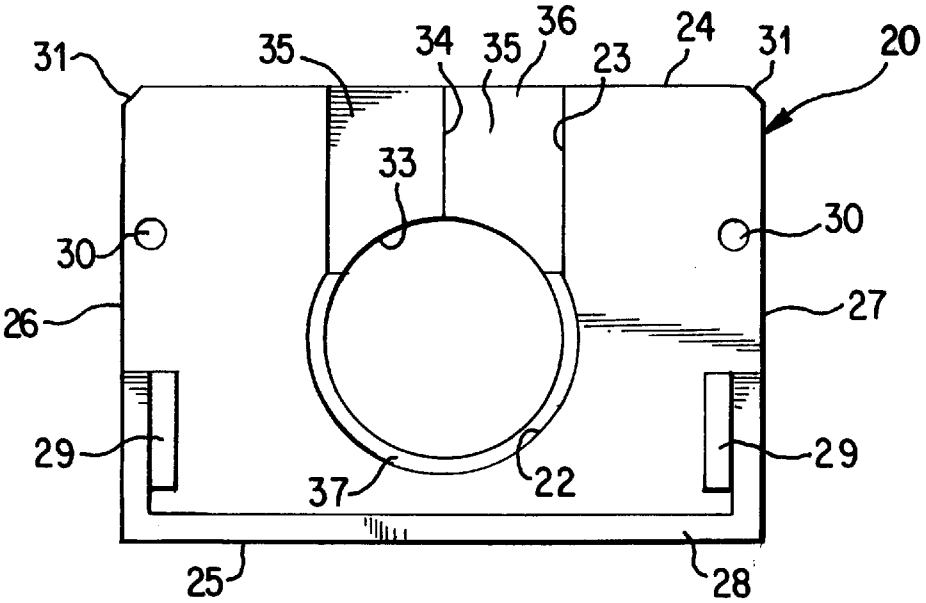

In a preferred embodiment of the grinding wheel shield 20 according to the invention as shown in FIGS. 2*a–c,* the shield is formed with a flat upper surface 21 having a central aperture therein 22 for accommodating the grinding wheel shaft and motor of a grinding machine (not shown) on which the shield is installed. Upper surface 21 is rectangular, having opposite first and second long sides 24 and 25, respectively, and opposite first and second short ends 26 and 27, respectively. An open keyway slot 23 extends from central aperture 22 to the first long edge 24. This keyway slot facilitates removal of the shield from around the grinding wheel shaft. A depending flange 28 extends downwardly from along the second long side 25 of the upper surface 21 as well as part way along each of the first and second short ends 26 and 27. Shield 20 further includes at least one positioning member projecting from depending flange 28. In the illustrated preferred embodiment, the at least one positioning member comprises a pair of positioning feet 29 projecting downwardly from the ends of depending flange 28 adjacent the inner surface of the flange and spaced from the outer surface of the flange.

Shield 20 is milled from a single solid block of resilient polymeric material, thereby forming a unitary article. A particularly preferred polymeric material is nylon, which has been found to exhibit an especially advantageous combination of properties in the environment of the invention. Of course, any other polymeric material which exhibits sufficient rigidity to maintain the essential shape of the shield, yet also is sufficiently resilient that it resists breakage, could be used.

A pair of mounting screw holes 30 are formed through the upper surface of the shield to facilitate securing the shield in its installed position in the water edge grinding machine. Desirably the corners 31 of the shield may be beveled to ease the insertion and removal of the shield.

The proportions of the central aperture 22 and the keyway slot 23 favorably affect the functionality of the shield of the invention. It has been found advantageous if the diameter of the central aperture has a diameter less than about 67% of the width of the upper surface of the shield. Preferably the central aperture will have a diameter in the range from about 60 to 63% of the width of the upper surface. It is also advantageous if the keyway slot has a width greater than 50% of the diameter of the central aperture. Preferably the keyway slot will have a width of at least 70% of the diameter of the central aperture, particularly preferably in the range from about 85 to 90%. Similarly, it is advantageous if the keyway slot has a width greater than 25% of the length of the upper surface of the shield. Preferably the keyway slot will have a width greater than 30% of the length of the upper surface, particularly preferably in the range from about 35 to 40%. In a particularly preferred embodiment of the invention, the central aperture has a diameter equal to about 60% of the width of the upper surface of the shield, and the keyway slot has a width equal to about 87.5% of the diameter of the central aperture and about 37% of the length of the upper surface of the shield.

In a particularly preferred embodiment of the invention, grinding wheel shield 20 further comprises a flexible sheet 32 disposed on flat surface 21. Flexible sheet 32 has an opening 33 which is aligned substantially coaxially with central aperture 22. A slit 34 extends from opening 33 along keyway slot 23 to the edge of the shield 24 so that at least one flap 35 is formed over the keyway slot. In the illustrated embodiment slit 34 is arranged approximately centrally over the keyway slot so that a pair of essentially symmetrical flaps is formed. It will be understood, however, that silt 34 could be offset from center to form unsymmetrical flaps or a single flap.

As seen most clearly in FIG. 2*b,* flaps 35 may comprise a double layer 36 of sheet material in order to increase the strength and rigidity of the flaps in the keyway area.

Also, as shown in FIG. 2*a,* opening 33 in sheet material 32 may be formed smaller in diameter than central aperture 22 in shield upper surface 21 so that the edge of the sheet material will form a flexible sealing lip 37 around the central aperture.

A preferred flexible sheet material is a rubber-like felt polishing pad material manufactured by Ciegal of Japan, Model No. 7356-000F, which is conventionally used in the polishing of silicon wafers This material comes with a self-adhesive backing and can be applied to the upper surface of the shield by merely stripping off the protective cover over the adhesive layer and applying the adhesive side of the felt to the upper surface of the shield. Of course, it is understood that any other flexible sheet material such as synthetic rubber having sufficient rigidity to maintain the flap position under normal conditions and sufficient resistance to the grinding dust and coolant used in the wafer edge grinding process, might be used in place of the preferred polishing pad material.

The shield of the invention is less expensive to manufacture than the conventional acrylic shield, but is considerably more durable and has a much longer service life. It avoids the need for an auxiliary skirt seal or retainer plate, yet more effectively reduces the blow-by of grinding dust and/or coolant. It can be removed without the need to dismantle the platform above the grinding wheel, thereby reducing the time required to return the grinding machine to service after periodic cleaning and increasing productivity. Thus the grinding wheel shield of the present invention represents a significant and economically valuable advance in the art.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A grinding wheel shield for an edge grinding machine, said shield being formed with a flat upper surface having a periphery defining a length and a width for said surface, and having a central aperture therein for accommodating a grinding wheel shaft and motor of a grinding machine on which the shield is installed, said aperture having a diameter, an open keyway slot leading from said central aperture to an adjacent edge of said shield, a depending flange extending from a portion of the periphery of said upper surface, at least one positioning member projecting from said depending flange, and a flexible sheet disposed on said flat upper surface of said shield, said sheet having an opening aligned with said central aperture and a slit extending from said opening along the keyway slot to an edge of the upper surface to form at least one flexible flap over the keyway slot, and said shield comprising a unitary member machined from a single block of resilient polymeric material.

2. A grinding wheel shield according to claim 1, wherein said resilient polymeric material is nylon.

3. A grinding wheel shield according to claim 1, wherein said upper surface is a rectangular surface having first and second long edges extending along opposite sides thereof and first and second short edges extending along opposite ends thereof, said keyway slot extending from the central aperture to a first long edge of said rectangular surface, said depending flange having inner and outer surfaces and extending along the second long edge thereof and from said second long edge to ends positioned part way along each of said first and second short edges thereof, and said at least one positioning member comprising first and second positioning feet projecting downwardly from the ends of said depending flange adjacent the inner surface of the depending flange and spaced from the outer surface of the depending flange.

4. A grinding wheel shield according to claim 1, wherein a pair of mounting screw holes are formed through said upper surface of the shield.

5. A grinding wheel shield according to claim 1, wherein said central aperture has a diameter less than about 67% of the width of said upper surface.

6. A grinding wheel shield according to claim 5, wherein said central aperture has a diameter from about 50 to 63% of the width of said upper surface.

7. A grinding wheel shield according to claim 1, wherein said keyway slot has a width greater than 50% of the diameter of said central aperture.

8. A grinding wheel shield according to claim 7, wherein said keyway slot has a width greater than 70% of the diameter of said central aperture.

9. A grinding wheel shield according to claim 8, wherein said keyway slot has a width of from about 85 to 90% of the diameter of said central aperture.

10. A grinding wheel shield according to claim 1, wherein said keyway slot has a width greater than 25% of the length of said upper surface.

11. A grinding wheel shield according to claim 10, wherein said keyway slot has a width greater than 30% of the length of said upper surface.

12. A grinding wheel shield according to claim 11, wherein said keyway slot has a width of from about 35 to 40% of the length of said upper surface.

13. A grinding wheel shield according to claim 1, wherein said slit is arranged approximately centrally over the keyway slot, whereby a pair of flaps is formed over the keyway slot.

14. A grinding wheel shield according to claim 1, wherein said at least one flexible flap comprises a double layer thickness of said flexible sheet material over the keyway slot.

15. A grinding wheel shield according to claim 1, wherein said opening in said sheet has a smaller diameter than said central aperture so that said sheet material forms a flexible scaling lip around said central aperture.

* * * * *